US006257371B1

(12) United States Patent
Wanner

(10) Patent No.: US 6,257,371 B1
(45) Date of Patent: Jul. 10, 2001

(54) LIFTING PLATFORM FOR DOUBLE-TRACKED VEHICLES

(75) Inventor: Hubert Wanner, Haldenwang (DE)

(73) Assignee: Maha Mashinenbau Haldenwang GmbH & Co. KG (DE)

( * ) Notice: Subject to any disclaimer, the term of this patent is extended or adjusted under 35 U.S.C. 154(b) by 0 days.

(21) Appl. No.: 09/345,932

(22) Filed: Jul. 1, 1999

(30) Foreign Application Priority Data

Jul. 13, 1998 (DE) ..... 298 12 459 U

(51) Int. Cl.[7] ..... B66F 7/28; B66B 1/01
(52) U.S. Cl. ..... 187/215; 187/204; 187/205
(58) Field of Search ..... 187/204, 215, 187/203, 216, 205, 343

(56) References Cited

U.S. PATENT DOCUMENTS

| | | | | |
|---|---|---|---|---|
| 2,443,405 | * | 6/1948 | Thompson | 187/205 |
| 2,464,731 | * | 3/1949 | Thompson | 187/205 |
| 3,593,209 | * | 7/1971 | Smith | 187/215 |
| 3,608,675 | * | 9/1971 | Sherry | 187/205 |
| 3,635,794 | * | 1/1972 | Petry | 187/205 |
| 3,880,299 | * | 4/1975 | Zollinger et al. | 414/273 |
| 4,319,666 | * | 3/1982 | Hunter | 187/204 |
| 4,447,042 | * | 5/1984 | Masui | 187/204 |
| 4,830,147 | * | 5/1989 | Kawada | 187/205 |
| 4,921,074 | * | 5/1990 | Ochs | 187/204 |
| 5,964,313 | * | 10/1999 | Guy | 180/332 |

FOREIGN PATENT DOCUMENTS

| | | | |
|---|---|---|---|
| 1857620 | 11/1961 | (DE) | B66F/7/28 |
| 73 32 957 | 12/1973 | (DE) | B66F/7/28 |
| 197 04 760 | 9/1997 | (DE) | B66F/7/28 |
| 2341515 | 9/1977 | (FR) | B66F/7/00 |

* cited by examiner

*Primary Examiner*—Eileen D. Lillis
*Assistant Examiner*—Paul T. Chin
(74) *Attorney, Agent, or Firm*—The Maxham Firm

(57) ABSTRACT

A lifting platform for double-tracked vehicles comprising two horizontal vehicle supports including support elements for the vehicle wheels. Also included are lifting elements for synchronously lifting and lowering the vehicle supports, a liftable and lowerable floor compensation formed of slip-proof plate members capable of providing support which cover the recess or space for the vehicle supports in the foundation or continuous footing when the vehicle supports are in their lifted position, and an axis elevator shiftable between the two vehicle supports in longitudinal rails. For completely covering not only the vehicle supports but also the axis elevator when the lifting platform is extended or retracted, the continuous footing is provided with a space for at least partially accommodating the lowered axis elevator, and the floor compensation is designed to also cover this space when the vehicle supports are in their lifted position.

12 Claims, 3 Drawing Sheets a)

b)

LIFTING PLATFORM FOR DOUBLE-TRACKED VEHICLES

BACKGROUND

1. Field of the Invention

The invention relates generally to a lifting platform for double-tracked vehicles, such as motor vehicles, and more particularly to such an apparatus having two horizontal vehicle supports including support elements for the vehicle wheels, and an axis elevator shiftable on longitudinal rails between the two vehicle supports.

2. Discussion of Related Art

Lifting platforms for motor vehicles of the accordion or jack type including a so-called axis elevator for lifting a vehicle axis are known. This axis elevator is a separate lifting device extending transversely to the two longitudinal supports and having a base capable of providing support and including pairs of traveling rolls disposed at the end sides thereof On this base, hydraulically operable lifting cross-bars are mounted, the upper telescopic bar of which is provided with two longitudinally adjustable support elements for the respective vehicle axis. The axis elevator can be manually moved under the respective vehicle axis by means of its pairs of traveling rolls running on inner longitudinal rails of the vehicle supports. By extending the thus positioned axis elevator, the respective vehicle axis is lifted by a predetermined amount so that the associated wheels are relieved and certain tests, for example, tests concerning the free motion of the axis, may be carried out.

In a number of applications, continuous footings having a relatively narrow central pit for receiving the hydraulic jacks and a box containing their drive units as well as two recesses extending in the longitudinal direction of the vehicle supports have proved to be particularly advantageous for lifting platforms of the jack-type. To cover the recesses on the floor level when the vehicle supports are in a lifted state and to thus generate an essentially continuous floor surface, a means referred to as floor compensation is provided which consists of a plate member capable of providing support and disposed in the respective recess to be liftable and lowerable, for example, by means of pressure fluid cushions, respectively. The pressure cushions are preferably filled with pressurized air in synchronism with a movement of the vehicle supports so that the plate members are lifted to their upper position on the floor level. As yet, however, it has been thought to be impossible to provide such jack-type lifting platforms accommodated in a continuous footing with an axis elevator.

From German utility model 7 332 957 a cover means for the foundation pits of hydraulic lifting platforms for motor vehicles is known wherein a small lifting cylinder, the piston of which carries a cover plate provided with a recess for the lifting platform jack, is associated with the lifting platform cylinder. When the lifting platform is extended, this closing plate is lifted to the floor level by the lifting piston and is fixed there. When the lifting platform is retracted, the closing plate is positioned under the support of the lifting platform. Additionally, a cover plate is provided which is taken along by the support of the lifting platform when the lifting platform is extended and which covers the foundation pit when the lifting platform is in its retracted state. This cover is only suitable for a specially designed lifting platform and poses relatively high technical requirements, particularly due to the two different cover elements as well as due to the additional pressure cylinder.

Further, from German patent publication 197 04 760 a drive-on lifting platform for motor vehicles is known, the lifting table of which is provided with rails for the reception of an additional transportation means for the wheels of the motor vehicle in the area of the two vehicle axes, these rails being mounted on the lifting table forming a pair transverse to the vehicle axis.

Additionally, from French patent 2 341 515 a drive-on lifting platform is known which comprises longitudinal rails which form the supports for the wheels of the vehicle to be lifted and are liftable and lowerable along a single vertical column. For additionally lifting the vehicle for the purpose of relieving the wheels of the vehicle, a lifting means capable of being lifted and lowered with the aid of pressure cushions is provided between the two longitudinal rails, the projecting support arms of which lifting means can be positioned under the axes of the vehicle to lift the vehicle from the two rails.

SUMMARY OF THE INVENTION

It is a primary purpose of this invention to provide a generic lifting platform which can be provided with an axis elevator.

According to the invention, this purpose is achieved in that the continuous footing has a space for at least partially accommodating the lowered axis elevator, and the floor compensation is formed to also cover this space when the vehicle supports are in a lifted state.

The lifting platform according to the invention comprises a continuous footing which, for the first time, enables the use of an axis elevator without endangering operating personnel involved with the test work. Since the cover of the space is a part of the floor compensation, this space is automatically covered by the automatic lifting movement of the floor compensation during the extension movement of the two vehicle supports so that there is a continuous floor surface even in this case.

According to a preferred embodiment of the invention, the part of the floor compensation covering the space is formed as a stable embossed plate fixedly connected to the two plate members at its end sides, for example, by bolts. This embodiment of extremely simple design enables the space together with the recesses for receiving the vehicle supports to be automatically covered by the two plate members.

To ensure a collision-proof retraction of the axis elevator into the space during a lowering motion of the vehicle carriers, at least one position switch electrically connected to the control unit for activating the lifting elements is allocated to the axis elevator. A lowering motion of the lifting platform into its lowest initial position is thus only possible if the position switch outputs a corresponding signal indicating the position of the axis elevator in its retraction position vertically above the space to the control unit. For this purpose, the control unit is advantageously provided with switching means which interrupt a lowering motion of the vehicle supports into its lower retracted position when such a release signal is missing.

BRIEF DESCRIPTION OF THE DRAWING

The objects, advantages, and features of the invention will be more readily perceived from the following detailed description, when read in conjunction with accompanying drawing, in which.

DETAILED DESCRIPTION OF THE PREFERRED EMBODIMENTS

Figure 1:
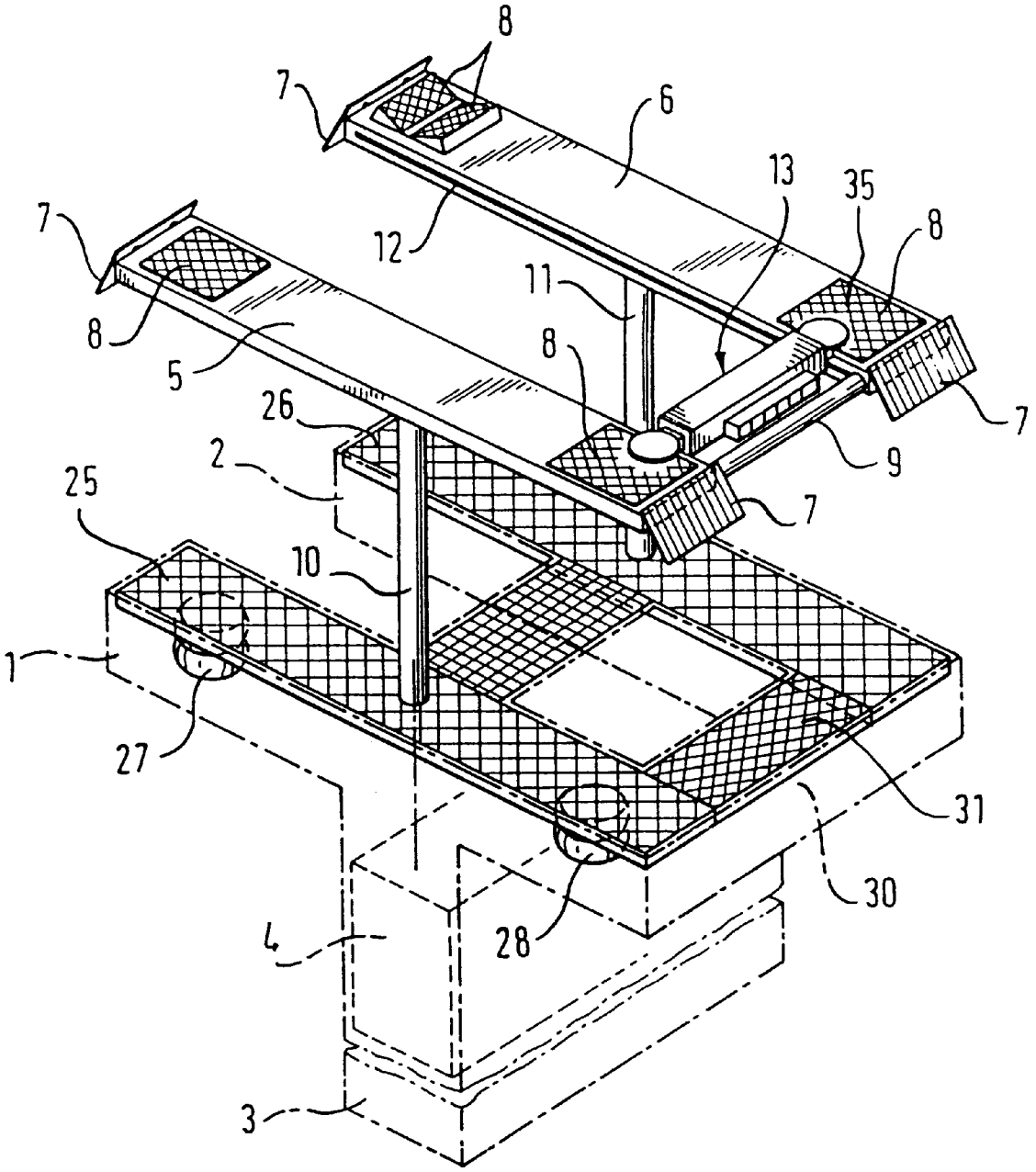
FIG. 1 is a schematic perspective view of a lifting platform with two jacks constructed in accordance with the invention.

The illustrated lifting platform with two jacks is mounted in a so-called continuous footing having two parallel elongated recesses 1, 2 and a central deep transverse pit 3. The transverse pit has a sufficient depth for accommodating the cylinders for the two lifting jacks as well as box 4 accommodating the drive unit and pressure agent lines, as well as a part of the control. The lifting platform is further provided with two parallel vehicle supports 5, 6 at the ends of which pivotable drive-on ramps 7 are mounted. On the upper side of vehicle supports 5, 6 there are support elements 8 for the wheels of a vehicle (not shown). Some or all of support elements 8 can be formed as so-called free motion detectors 35 capable of measuring the free movement of the axis of each wheel. The parallel orientation of vehicle supports 5, 6 is ensured by a connection element formed as a rigid pipe 9 attached between the end parts of the two vehicle supports at the right side according to FIG. 1. Rigid pipe 9 also serves as an additional torsion prevention for vehicle supports 5, 6 which are supported centrally on each jack 10, 11. At the narrow sides facing each other each vehicle carrier 5, 6 is provided with a continuous stable profile rail 12. A lifting device referred to as axis elevator 13 is transversely disposed between vehicle supports 5, 6 and respectively supported on one of the two profile rails 12 with a preferably U-shaped cross-section (see FIG. 3) by pairs of traveling rolls at the end sides. Axis elevator 13 is provided with transverse bar 14 serving as a base and carrying a pair of travel rolls 15, 16 at its two front ends, respectively. On this base 14, lifting cross-bars 17 are mounted which can, for lifting purposes, be spread in a conventional way via a pressure cylinder. At the upper ends of the two arms of the cross-bars is mounted a hollow square support bar 18 having an adjustable square profile 19 and a support element 20 at each end. At a side wall 21 of base 14 there are the control buttons or switching means 34 for activating the axis elevator and display 33. Further, a switching element formed as a part of a position switch 22 (FIG. 2*a*) is provided at at least one front side of base 14, the other part of position switch 22 being mounted on the associated profile rail 12 of the respective vehicle support 5 or 6 in a predetermined position.

Figure 2:
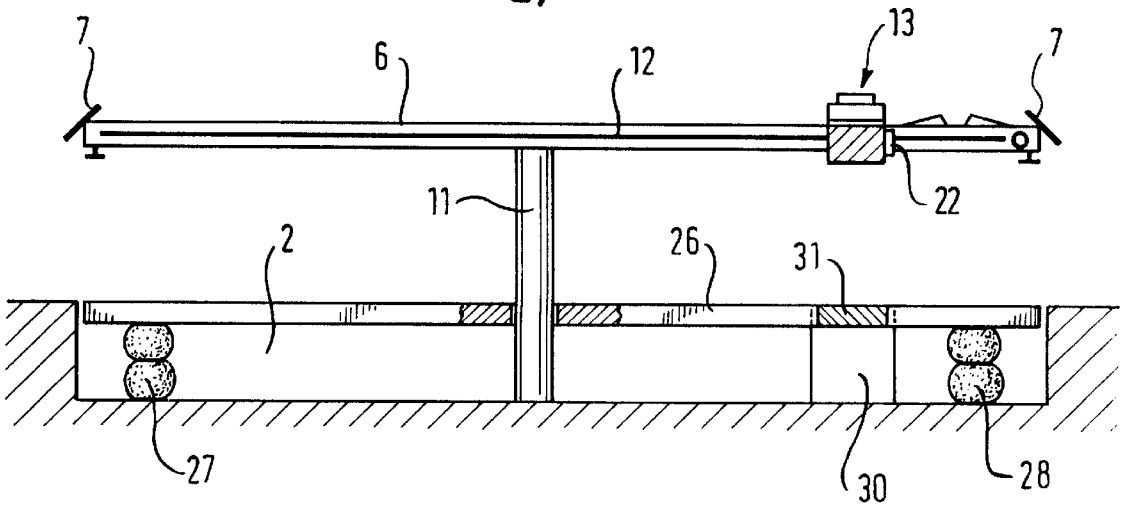
FIGS. 2*a* and 2*b* are schematic illustrations of the lifting platform according to FIG. 1 in a lifted and a lowered operation state, respectively.
Figure 2:
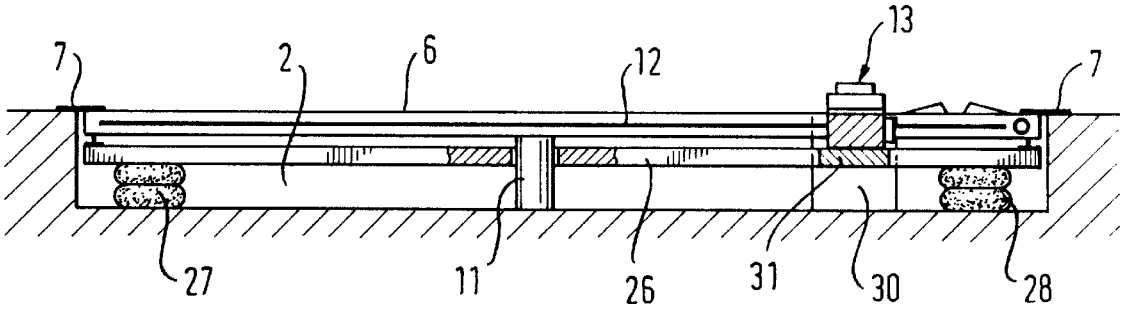
Figure 3:
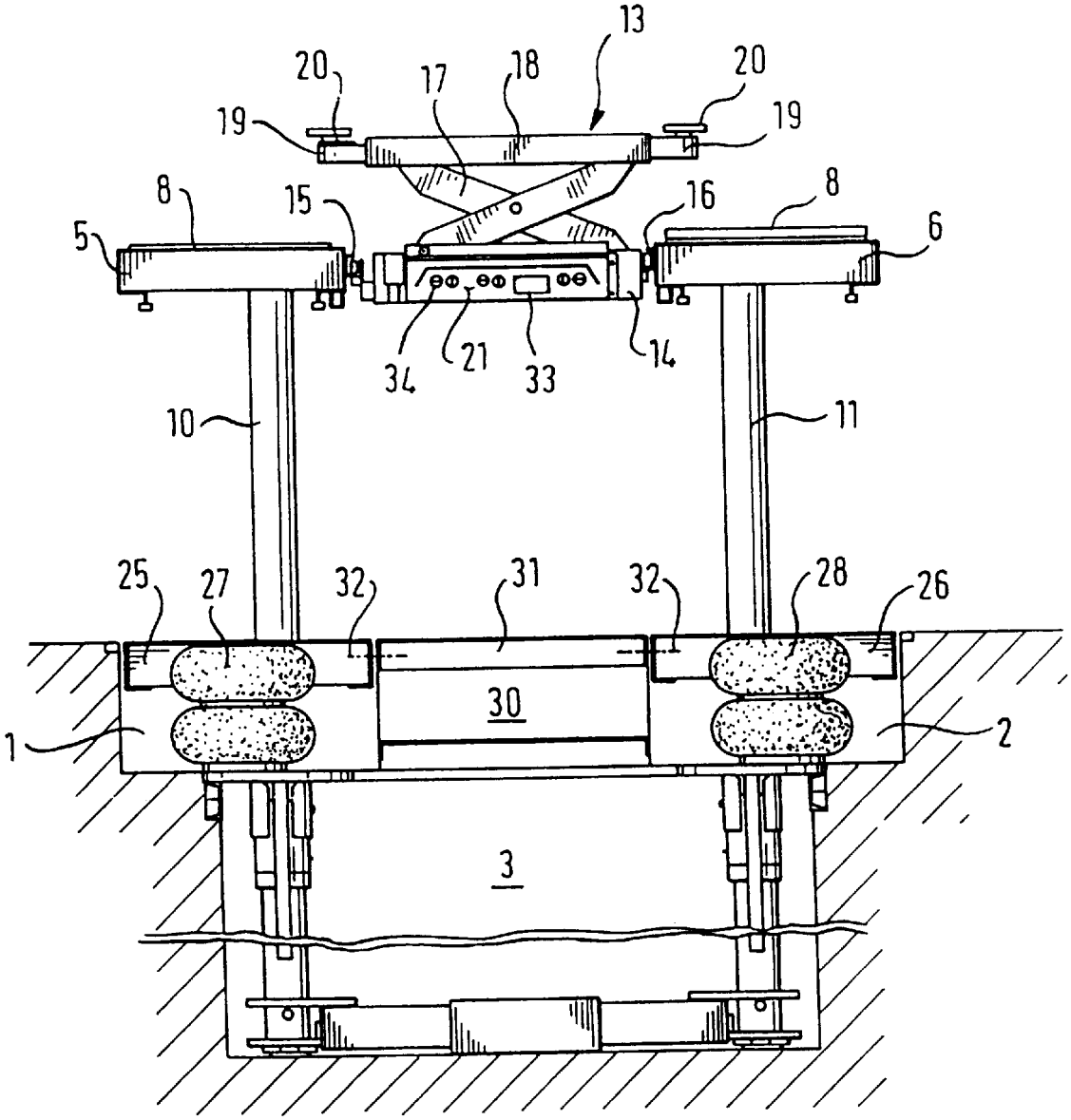
FIG. 3 is a schematic transverse illustration of the lifting platform according to FIG. 1 with the axis elevator extended.

The lifting platform of the invention further comprises a so-called floor compensation shown in detail in FIGS. 2 and 3. This floor compensation includes two elongated plate members 25, 26 having roughened or corrugated slip-proof surfaces, the shape and size of which are slightly smaller than recesses 1 and 2, so that each plate member 25, 26 fills the associated recess while forming a narrow margin. In recess 1, 2 and the respective plate members, two pressurized air cushions 27, 28 are disposed, respectively. These cushions can be evacuated or filled with pressurized air via lines (not shown) by a valve operation according to appropriate control instructions.

As can be seen from FIG. 1, a space 30 connecting recesses 1 and 2 is formed in the foundation of the continuous footing under the position of axis elevator 13, the height of which space approximately corresponds to that of recesses 1, 2. Axis elevator 13 is lowered into space 30 on lowering of vehicle supports 5,6, and the upper parts of axis elevator 13 protrudes above the floor level in the lowest lowered position according to FIG. 2*b*. For covering space 30 when vehicle supports 5, 6 are in their lifted positions, as shown in FIG. 2*a*, the floor compensation comprises transverse plate 31 of slightly smaller dimensions than space 30. The two front ends of transverse plate 31 are durably attached to the two plate members 25 and 26, for example, by means of screws. As can be seen from FIGS. 1 and 2*a*, the two longitudinal plate members 25, 26 have been moved from the lower position shown in FIG. 2*b* to the upper position when vehicle supports 5, 6 are in their lifted positions and pressure cushions 27, 28 are filled, so that recesses 1, 2 are covered by these plate members at the floor level. Since plate 31 is rigidly connected to plate members 25, 26, it is taken along with their lifting and lowering motions and covers space 30 on the floor level in its upper position shown in FIG. 2*a*.

When transverse bar 9, serving as a torsion prevention for vehicle supports 5, 6, is provided on the one end part of the vehicle supports in the manner shown in FIG. 1, space 30 advantageously has a sufficient width to accommodate axis elevator 30 and also the transverse bar. Corresponding to this increased width, plate 31 is then also formed in an increased width. As shown in FIG. 2, space 30 can also be disposed in front of the end portion of spaces 1 and 2, the predetermined position of the axis elevator not necessarily being on one end of the vehicle supports 5, 6, as in the embodiment according to FIG. 1, but displaced to the center vertically above the space 30 in this case.

The invention is not limited to the embodiments described above and shown in the drawing. Thus, for example, instead of pressure cushions 27, 28, other lifting elements may be provided for vertically moving plate members 25, 26. Further, plate 31 can also be formed as a separate component and may be provided with its own lifting elements, such as, springs, particularly gas springs, and it may be fixed in the one or in the other, or both, final position by locking elements which may be automatically operable. By measurements of design concerning axis elevator 13 or its longitudinal guide, the axis elevator may be fully lowered into the space 30 so that it does not protrude above the floor level in its lowest position and can not be damaged by being driven on while the risk of personnel stumbling over it is eliminated. In this case, advantageously, cover plates are provided which may be operated manually or automatically to cover space 30 with axis elevator 13 accommodated therein on the floor level. The invention is suitable for all kinds of lifting platforms of the jack type integrated in a so-called continuous footing or a similarly formed foundation under the floor.

In view of the above description it is likely that modifications and improvements will occur to those skilled in the relevant technical field which are within the scope of the accompanying claims. The invention is to be limited only by the appended claims considering their spirit and scope, and equivalents.

What is claimed is:

1. A lifting platform apparatus for double-tracked, wheeled vehicles, the lifting platform being configured to be mounted in a continuous footing, the apparatus including a control unit and comprising:

two horizontal vehicle supports provided with support elements for the vehicle wheels;

lifting elements for synchronously lifting and lowering said vehicle supports;

an axis elevator shiftably disposed in longitudinal rails between said two vehicle supports, a continuous footing being provided with a space for at least partially accommodating said axis elevator when it is in its lowered position;

a liftable and lowerable floor compensation formed of plate members capable of providing support and covering the spaces provided in the footing for said vehicle supports when said vehicle supports are in their lifted positions;

a further floor compensation element formed so as to also cover said space to accommodate said axis elevator when said vehicle supports are in their lifted position;

a control unit functionally connected to said axis elevator, said control unit comprising switching means; and position switches allocated to said axis elevator, said position switches being connected to said control unit for activating said lifting elements, wherein said switching means interrupts a lowering movement of said vehicle supports to their lowest retracted position when the position switch does not send a release signal.

2. The apparatus recited in claim 1, wherein said further floor compensation element is a transverse plate, the ends of said transverse plate being fixedly connected to both of said plate members of said floor compensation.

3. The apparatus recited in claim 2, wherein said further floor compensation element has a slip-proof upper surface.

4. The apparatus recited in claim 1, wherein said control unit further comprises a display that can be activated by said position switches.

5. The apparatus recited in claim 4, wherein said further floor compensation element is a transverse plate, the ends of said transverse plate being fixedly connected to both of said plate members of said floor compensation.

6. The apparatus recited in claim 1, wherein at least one of said support elements includes a detector for measuring the free movement of an axis of the vehicle being supported by said apparatus.

7. The apparatus recited in claim 1, wherein said plate members have a slip-proof upper surface.

8. The apparatus recited in claim 1 or 2, wherein said plate members are liftable and lowerable by means of pneumatic pressure cushions.

9. The apparatus recited in claim 1 or 2, and further comprising a transverse connector connected between said vehicle supports and disposed next to said axis elevator when in its lowered position, said transverse connector being at least partially accommodated in said space when said vehicle supports are in their lowered position.

10. The apparatus recited in claim 1 or 2, wherein said axis elevator is a hydraulic cross-bar elevator.

11. The apparatus recited in claim 1 or 2, wherein said axis elevator is a one-jack axis elevator.

12. The apparatus recited in claim 1 or 2, wherein said axis elevator can be fully retracted into said space, said apparatus further comprising a cover capable of providing support to cover said space with said axis elevator accommodated therein.

* * * * *